US009435204B2

(12) United States Patent
Horn

(10) Patent No.: US 9,435,204 B2
(45) Date of Patent: Sep. 6, 2016

(54) STRUCTURALLY EFFICIENT COOLED ENGINE HOUSING FOR ROTARY ENGINES

(75) Inventor: Mark David Horn, Granada Hills, CA (US)

(73) Assignee: United Technologies Corporation, Farmington, CT (US)

( * ) Notice: Subject to any disclaimer, the term of this patent is extended or adjusted under 35 U.S.C. 154(b) by 565 days.

(21) Appl. No.: 13/052,859

(22) Filed: Mar. 21, 2011

(65) Prior Publication Data

US 2012/0240885 A1 Sep. 27, 2012

(51) Int. Cl.

| | |
|---|---|
| ***F02B 53/00*** | (2006.01) |
| ***F01C 21/10*** | (2006.01) |
| ***F01C 21/06*** | (2006.01) |
| *F01C 1/22* | (2006.01) |
| *F01C 11/00* | (2006.01) |

(52) U.S. Cl.

CPC ..... *F01C 21/106* (2013.01); *F01C 21/06* (2013.01); *F01C 1/22* (2013.01); *F01C 11/004* (2013.01)

(58) Field of Classification Search

CPC .. F02B 2053/005; F02B 55/10; Y02T 10/17; F01C 21/06; F01C 21/106; F01C 1/22; F01C 11/004; F01D 5/143

USPC ..... 123/41.29, 41.79, 43 B, 44 R; 418/55.3–55.4, 65, 85, 92, 96

See application file for complete search history.

(56) References Cited

U.S. PATENT DOCUMENTS

| | | | | |
|---|---|---|---|---|
| 3,007,460 | A * | 11/1961 | Bentele et al. | 418/83 |
| 3,151,807 | A | 10/1964 | Froede et al. | |
| 3,313,276 | A * | 4/1967 | Ito et al. | 418/61.2 |
| 3,791,235 | A | 2/1974 | Woodier et al. | |
| 3,849,035 | A | 11/1974 | Jones | |
| 3,937,185 | A * | 2/1976 | Dixon et al. | 123/211 |
| 3,951,112 | A | 4/1976 | Hunter | |
| 3,964,445 | A * | 6/1976 | Ernest et al. | 418/83 |
| 4,019,469 | A | 4/1977 | Yamamoto et al. | |
| 4,030,454 | A | 6/1977 | Yamamoto et al. | |
| 4,037,998 | A * | 7/1977 | Goloff | 418/83 |
| 4,108,137 | A | 8/1978 | Yamamoto et al. | |
| RE29,759 | E | 9/1978 | Yamamoto | |
| 4,826,410 | A | 5/1989 | Yamamoto et al. | |
| 4,915,603 | A | 4/1990 | Corbett et al. | |
| 5,075,966 | A | 12/1991 | Mantkowski | |
| 5,100,309 | A | 3/1992 | Eiermann et al. | |

(Continued)

FOREIGN PATENT DOCUMENTS

| | | |
|---|---|---|
| WO | 2010042692 | 4/2010 |
| WO | 2010042693 | 4/2010 |
| WO | 2010047960 | 4/2010 |

OTHER PUBLICATIONS

K. Yamamoto, "Rotary Engine", Sankaido Co., Ltd., Japan, 1981, Copyright 1981 Toyo Kogyo Co., Ltd., Mazda Rotary Engine, License NSU-Wankel.

*Primary Examiner* — Thomas Denion
*Assistant Examiner* — Thomas Olszewski
(74) *Attorney, Agent, or Firm* — O'Shea Getz P.C.

(57) ABSTRACT

An engine includes a housing having a single wall, where the wall has a rib and a flange, and the wall provides a primary structure and cooling for the engine. A closeout is attached to an outer surface of the wall, and the closeout and the wall form a cavity. The closeout provides a secondary structure for containing a coolant fluid flow within the cavity. The closeout may be corrugated, and the ribs may be exposed to the cavity.

13 Claims, 7 Drawing Sheets

(56) References Cited

U.S. PATENT DOCUMENTS

| | | | | |
|---|---|---|---|---|
| 7,739,872 | B2 | 6/2010 | Murphy et al. | |
| 2008/0047700 | A1 | 2/2008 | Fowser et al. | |
| 2009/0159355 | A1* | 6/2009 | Garwood et al. | 123/44 R |
| 2009/0250036 | A1 | 10/2009 | Lauter | |
| 2010/0206261 | A1* | 8/2010 | Berghian et al. | 123/193.2 |
| 2010/0269782 | A1 | 10/2010 | Minick et al. | |

* cited by examiner

STRUCTURALLY EFFICIENT COOLED ENGINE HOUSING FOR ROTARY ENGINES

BACKGROUND

1. Technical Field

The present application relates to a rotary engine, and in particular to a rotary engine that includes a structurally efficient liquid cooled rotor housing.

2. Background Information

Engines typically compress air or other gaseous oxidizers prior to adding fuel and ignition to produce power. Many examples of engines with separable positive displacement compression systems exist. One example can be conceptualized from a Wankel engine. The Wankel engine, invented by German engineer Felix Wankel is a type of internal combustion engine which uses a rotary design. Its cycle takes place in a space between the inside of an oval-like epitrochoid-shaped housing and a rotor that is similar in shape to a Reuleaux triangle but with sides that are somewhat flatter. This design delivers smooth high-rpm power from a compact size. Since its introduction, the engine has been commonly referred to as the rotary engine.

An improvement on the rotary engine uses a first rotor as a compressor to provide compressed air to a second rotor. The compressed air is then further compressed in the second rotor in advance of combustion. In some embodiments the exhaust of the second rotor is returned to the expanding section of the compressor rotor, thereby providing power recovery and increasing efficiency. This configuration has been referred to as a compound rotary engine. An example of such an engine is disclosed in U.S. Patent Publication 2010/0269782, assigned to the assignee of the present application.

Rotary engine housings suffer from structural inefficiency and non-uniform cooling, resulting in increased weight and reduced engine life as well as relatively complex and expensive castings. Specifically, the traditional rotor housing is fabricated from a single piece casting with complex internal passages for cooling fluid to flow through to provide convective cooling of the housing.

There is a need for a structurally efficient liquid cooled rotor housing for a rotary engine.

DETAILED DESCRIPTION

Figure 1:
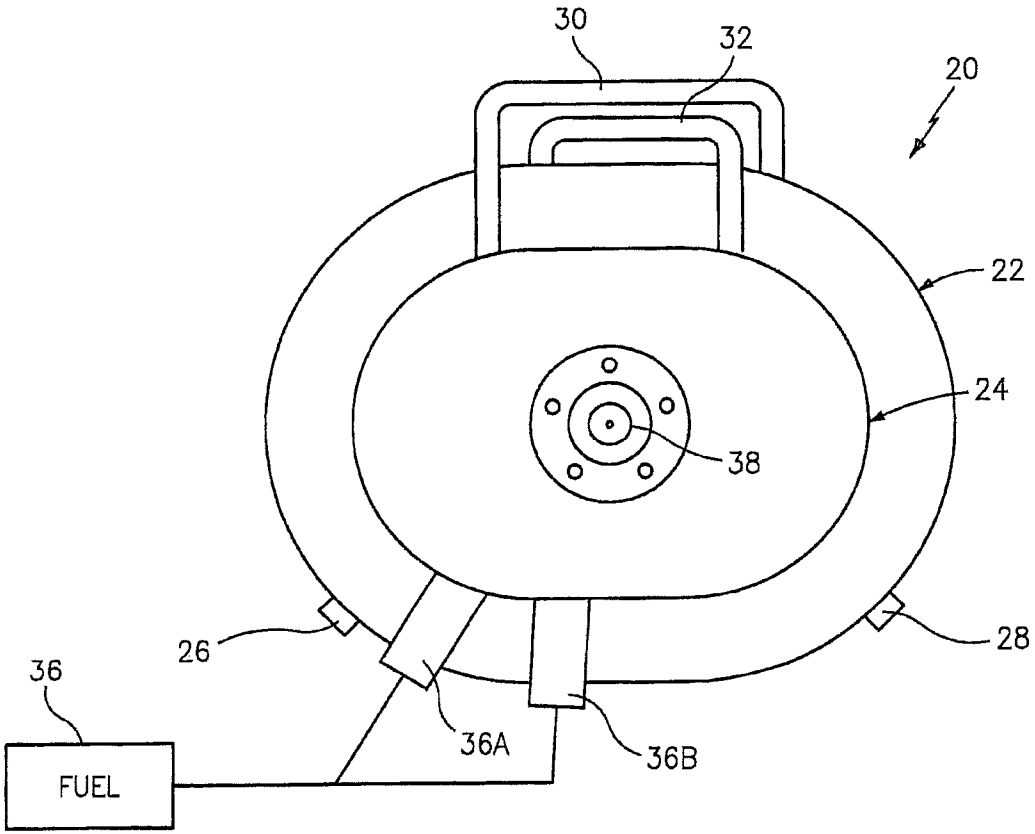
FIG. 1 is a schematic block diagram illustration of a compound rotary engine.

FIG. 1 schematically illustrates a rotary engine 20 having a first rotor section 22 and a second rotor section 24. The engine 20 is based on a rotary, e.g., Wankel-type engine. An intake port 26 communicates ambient air to the first rotor section 22 and an exhaust port 28 communicates exhaust products therefrom. A first transfer duct 30 and a second transfer duct 32 communicate between the first rotor section 22 and the second rotor section 24. A fuel system 36 for use with a heavy fuel such as JP-8, JP-4, natural gas, hydrogen diesel and others communicate with the second rotor section 24 of the engine 20. The engine 20 simultaneously offers high power density and low fuel consumption for various commercial, industrial, compact portable power generation, and aerospace applications.

Figure 2:
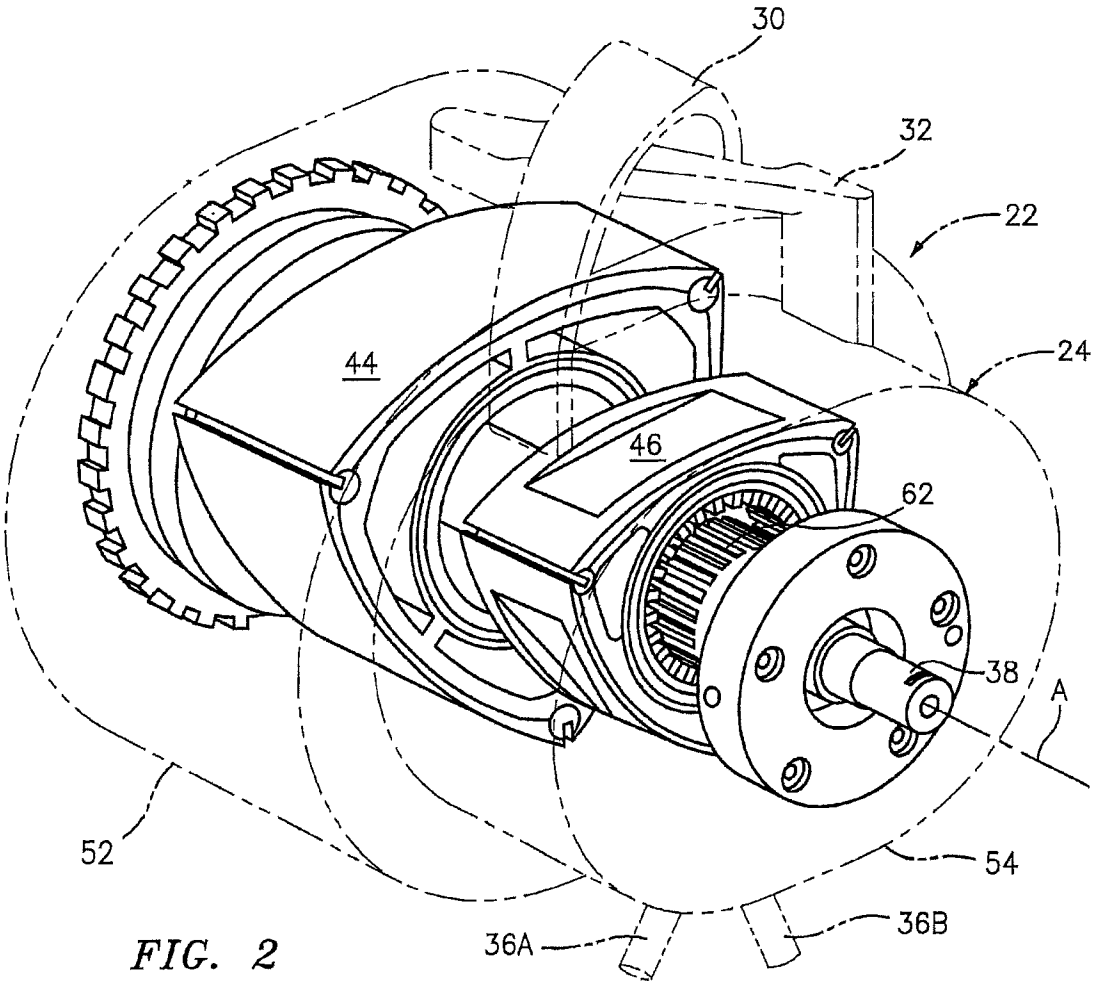
FIG. 2 is a partial phantom view of the rotary engine of FIG. 1.
Figure 3:
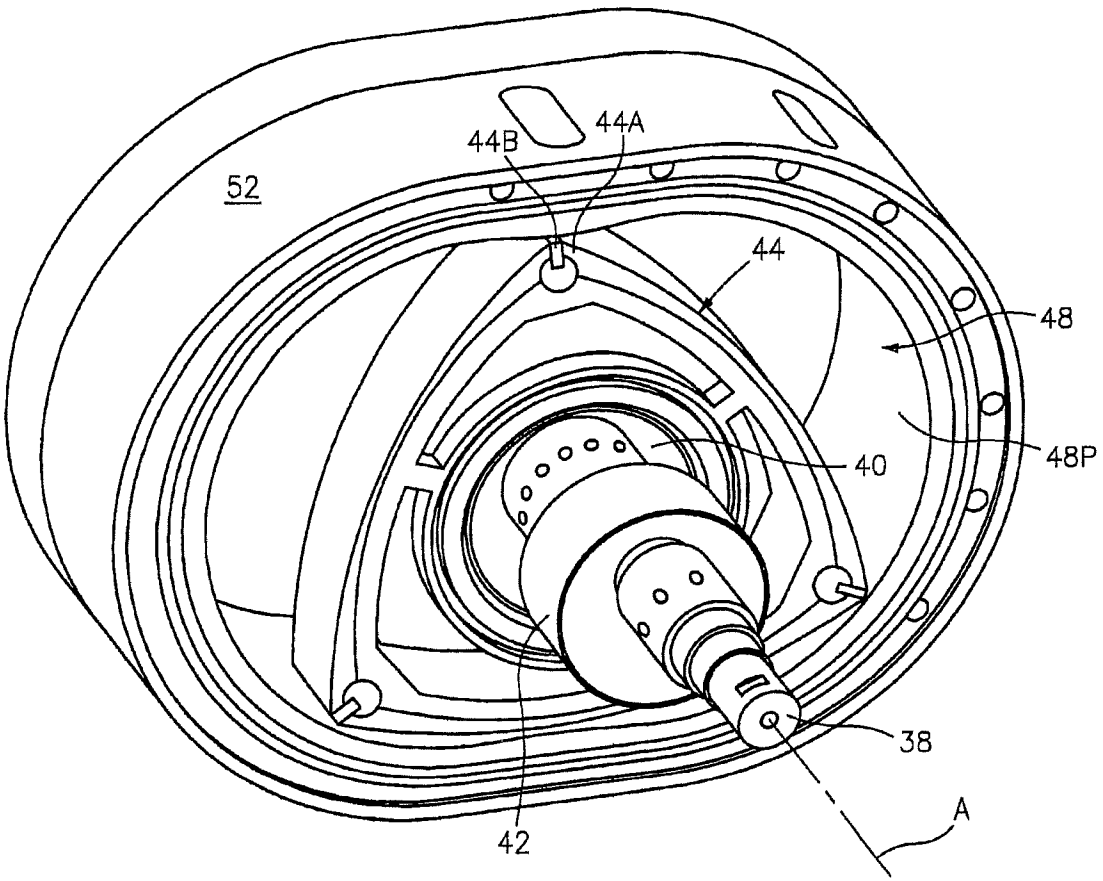
FIG. 3 is a partially assembled view of the rotary engine of FIG. 1 illustrating the first rotor section.
Figure 4:
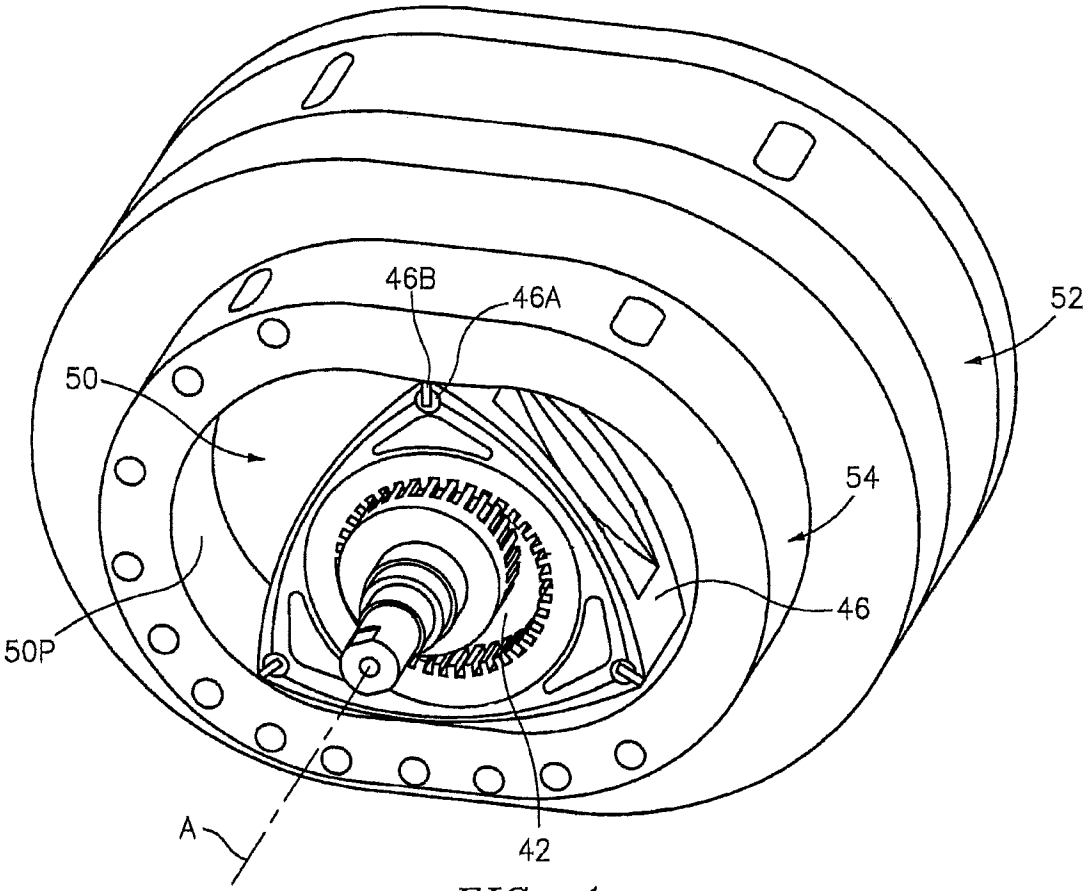
FIG. 4 is a partially assembled view of the rotary engine of FIG. 1 illustrating the second rotor section.
Figure 5:
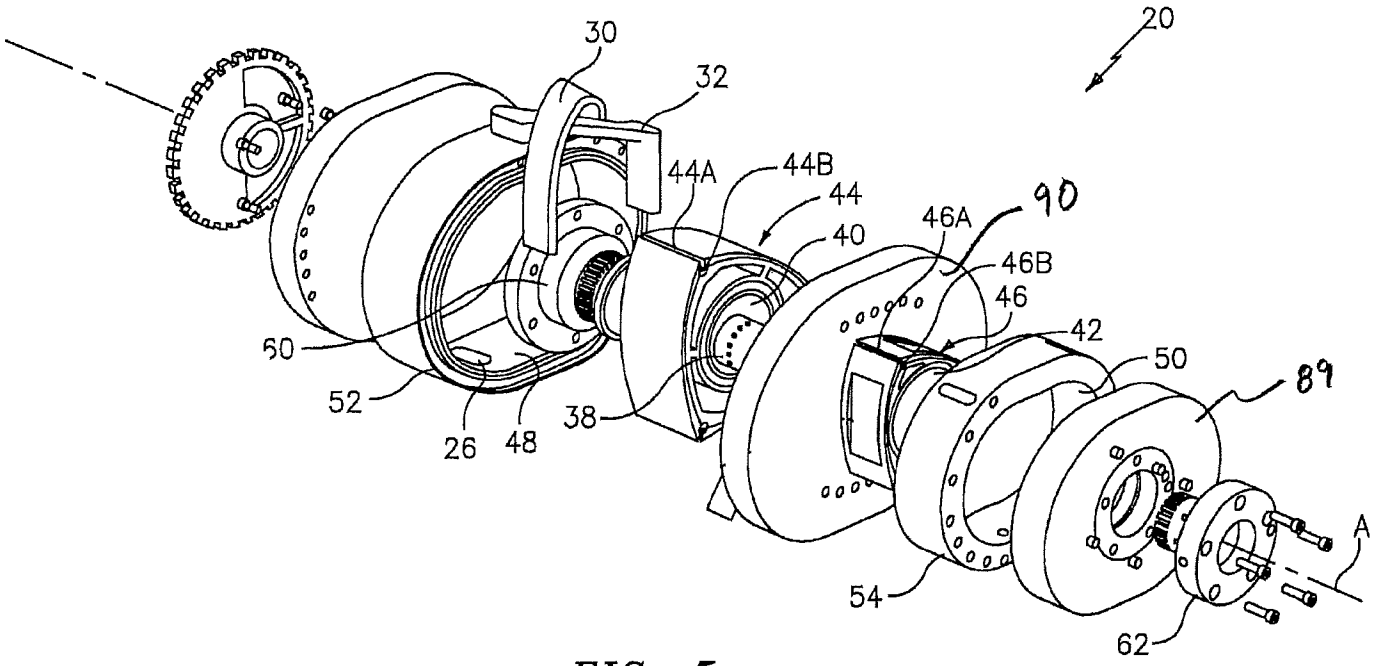
FIG. 5 is an exploded view of the rotary engine of FIG. 1.

Referring to FIG. 2, the rotary engine 20 generally includes at least one shaft 38 which rotates about an axis of rotation A. The shaft 38 includes aligned eccentric cams 40, 42 (FIGS. 3 and 4) which drive a respective first rotor 44 and second rotor 46 which are driven in coordinated manner by the shaft 38. The first rotor 44 and second rotor 46 are respectively rotatable in volumes 48, 50 formed by a stationary first housing 52 and a stationary second housing 54 (FIGS. 3 and 4). The housings may include trochoidal inner surfaces that define the volumes. The fuel system 36 may include one or more fuel injectors with two fuel injectors 36A, 36B shown in communication with the second rotor volume 50 generally opposite the side thereof where the transfer ducts 30, 32 are situated. It should be understood that other fuel injector arrangement, locations and numbers may alternatively or additionally be provided. The fuel system 36 supplies fuel into the second rotor volume 50. The first rotor volume 48 in this embodiment provides a greater volume than the second rotor volume 50. It should be understood that various housing configurations shapes and arrangements may alternatively or additionally be provided (FIG. 5).

The first rotor 44 and the second rotor 46 have peripheral surfaces which include three circumferentially spaced apexes 44A, 46A respectively. Each apex 44A, 46A includes an apex seal 44B, 46B, which are in a sliding sealing engagement with a peripheral surface 48P, 50P of the respective volumes 48, 50. The surfaces of the volumes 48, 50 in planes normal to the axis of rotation A are substantially those of a two-lobed epitrochoid while the surfaces of the rotors 44, 46 in the same planes are substantially those of the three-lobed inner envelope of the two-lobed epitrochoid.

In operation, air enters the engine 20 through the intake port 26 (FIG. 1). The first rotor 44 provides a first phase of compression and the first transfer duct 30 communicates the compressed air from the first rotor volume 48 to the second rotor volume 50 (FIGS. 2 and 3). The second rotor 46 provides a second phase of compression, combustion and a first phase of expansion, then the second transfer duct 32 communicates the exhaust gases from the second rotor volume 50 to the first rotor volume 48 (FIGS. 2 and 4). The first rotor 44 provides a second phase of expansion to the exhaust gases, and the expanded exhaust gases are expelled though the exhaust port 28 (FIGS. 1 and 2). The shaft 38 completes one revolution for every cycle, so there are three (3) crank revolutions for each complete rotor revolution. As each rotor face completes a cycle every revolution and there are two rotors with a total of six faces, the engine produces significant power within a relatively small displacement.

The shaft 38 may include axially separable sections which, may be separable between the cams 40, 42 to facilitate assembly. Alternatively or additionally, the first rotor cam 40 and the second rotor cam 42 may also be separable sections. The separable sections of the shaft 38 may be assembled through a tie rod or other fastener arrangement to facilitate assembly such as assembly of the rotationally stationary gears 60, 62.

The shaft 38 may also support bearings, bushings or other low-friction devices about enlarged shaft portions. The enlarged shaft portions permit relatively large diameter bearings, bushings or other low-friction devices to provide a robust and reliable interface which increase structural rigidity and reduce lubrication requirements.

Figure 6:
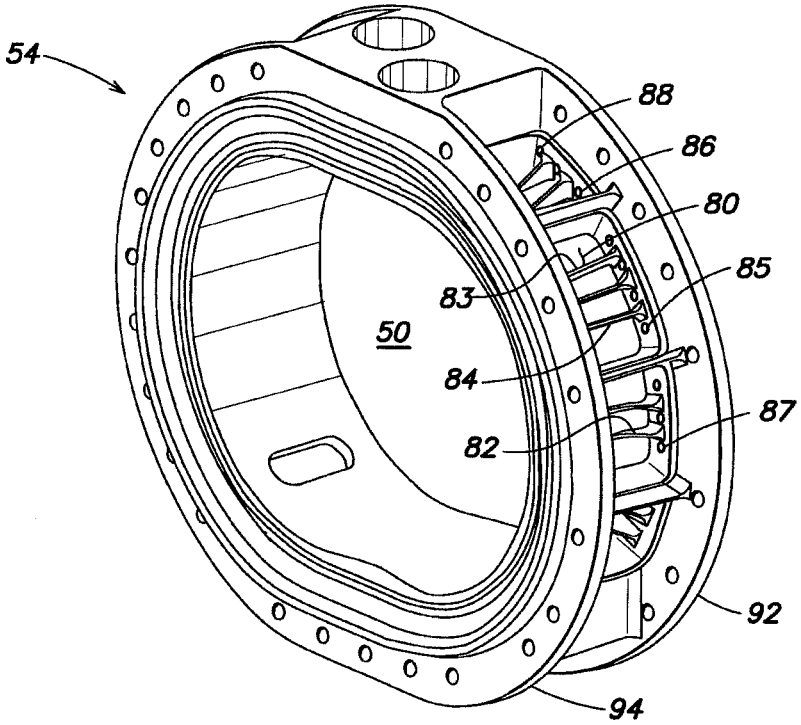
FIG. 6 is a perspective view of a primary rotor housing detail of the second rotor housing.

FIG. 6 is a perspective view of a primary rotor housing detail of the second housing 54, where the detail includes a cooling surface 80. The detail may be for example machined or cast from aluminum, titanium or steel. The surface 80 is sub-divided into a plurality of sections by a plurality of axial fins, for example 82-84. The fins 82-84 provide increased rigidity and improved cooling to the hot surface 80. Liquid coolant flows through holes, for example 85-88, and the coolant flow is primarily axial. Side housings 89, 90 (FIG. 5) may be connected to the second housing 54 via through holes in flanges 92, 94.

Figure 7:
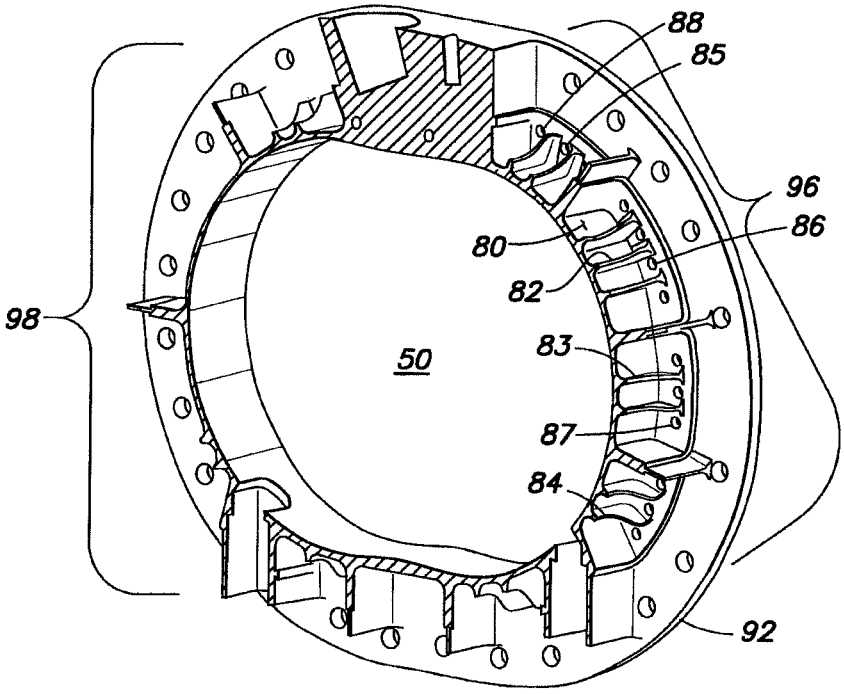
FIG. 7 is a cross-sectional illustration taken along the plane perpendicular to the axial midpoint of the primary rotor housing detail illustrated in FIG. 6.

FIG. 7 is a cross-sectional illustration taken along the plane perpendicular to the axial midpoint of the primary rotor housing detail illustrated in FIG. 6. Area 96 in the vicinity of the fuel injector through hole is typically exposed to the highest local heat fluxes in the engine combustion zone, requiring increased local cooling to reduce life limiting thermal strains. This region also experiences the highest pressures within the engine cycle. Therefore, it is contemplated that additional ribs may be located in the vicinity of the fuel injector through holes to provide additional cooling surfaces and to provide structural integrity while maintaining thin walls between the coolant and the combustion zone. These structural support fins also provide increased cooling effectiveness by functioning as cooling fins, protruding into the coolant flow and enhancing convective heat transfer. Cooler areas of the inner surface 80, such as for example area 98 of the intake port, may require less ribs to transfer heat from the coolant to the surface 80 in that vicinity. These regions also see reduced internal operating pressures, allowing for simultaneous optimization of cooling and structure with the envisioned approach. In the case of spark ignition engines the additional ribs may be located in the vicinity of the spark plug(s).

Figure 8:
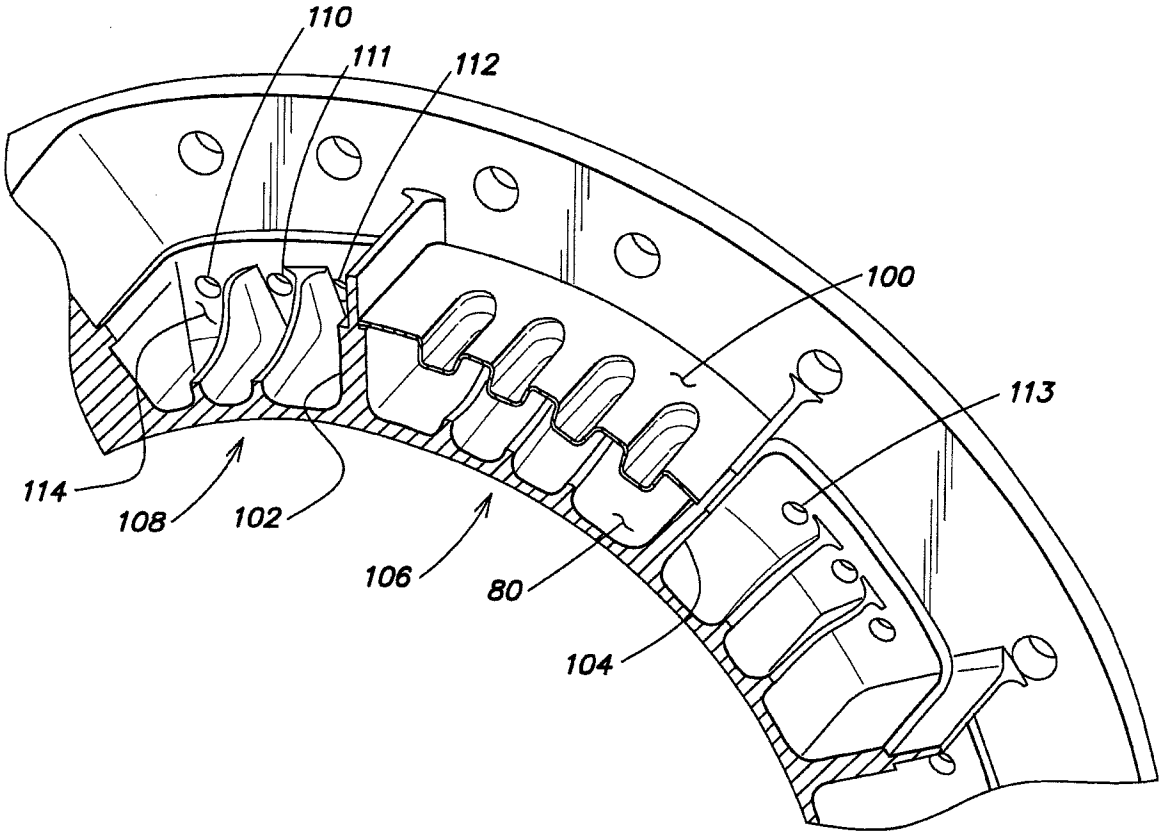
FIG. 8 is an exploded cross-sectional illustration of the inner surface of the primary rotor housing detail and a cooperating corrugated closeout which together form a coolant flow chamber.

FIG. 8 is an exploded cross-sectional illustration of the inner surface 80 and a cooperating corrugated metallic closeout 100. The closeout 100 may be fabricated from sheet metal and welded to ribs 102, 104 to form a first axial flow chamber 106 in cooperation with the inner surface 80. The closeout for an adjacent second axial flow chamber 108 is removed to illustrate coolant holes 110-113 for the adjacent chamber in a first side surface 114. Each chamber may include one or more coolant holes in the axial sidewall. Other materials and attachment mechanisms are also viable in this application, including attachment by adhesives, mechanical fasteners or brazing, as well as bonded non-metallic closeouts.

In contrast to the prior art which used a single piece casting to create internal axial coolant flow passages in the rotor housing, the rotor housing 54 includes a primary rotor housing detail and a secondary closeout sheet which together form axial flow passages. The primary housing detail reacts engine loads and provides cooling of the combustion chamber wall to maintain temperatures within engine operating constraints, while the closeout sheet forms the passages with an inner surface of the rotor housing. The corrugated structure of the closeout performs two functions. It provides structural stiffness to the closeout while keeping weight to a minimum. Since the primary housing detail carries the engine internal loads (e.g., pressure, thermal, torque and bearing loads) as well as the engine external loads (e.g., thrust, torque, vibration, mounting and other interface loads), the closeout only has to accommodate coolant pressure loads and is significantly free of engine loads. The closeout also serves to locally control the cross sectional flow area for the coolant. The corrugation geometry (spacing and profile) are varied to change the local cross sectional flow area between the primary housing detail and the closeout. This capability provides another parameter for local optimization of coolant convective heat transfer by allowing increased coolant velocities without requiring higher coolant flow rates. While there may be some small but measurable amount of engine load transferred to the closeout from the primary housing detail, the amount of load is significantly smaller that the engine load on the primary housing detail, and therefore the closeout is considered to be significantly "free" of carrying engine loads.

The improved rotor housing may of course also be employed in a rotary engine that uses single rotor. Although the embodiment(s) presented herein illustrate axial coolant flow, one of ordinary skill will of course recognize that a primary housing detail and one or more closeout sheets may also be combined for example, to form circumferential flow passages, or a combination of axial, radial and/or circumferential flow passages.

It will be understood by those skilled in the art that various changes in form and detail thereof may be made without departing from the spirit and scope of the claims.

What is claimed is:

1. An apparatus for an engine, comprising:

a tubular housing structure extending along a centerline and comprising:

an inner wall portion extending about and axially along the centerline;

a first flange projecting radially out from the inner wall portion;

a second flange projecting radially out from the inner wall portion;

a first rib projecting radially out from the inner wall portion, and extending axially between the first flange and the second flange; and a second rib projecting radially out from the inner wall portion, and extending axially between the first flange and the second flange; and a closeout radially recessed into a side of and forming a cavity with the tubular housing structure, and the closeout attached to the tubular housing structure;

wherein the cavity extends axially between the first flange and the second flange, laterally between the first rib and the second rib, and radially outward from the inner wall portion to the closeout.

2. The apparatus of claim 1, wherein the closeout is welded to the tubular housing structure.

3. The apparatus of claim 1, where the closeout carries a load from coolant within the cavity and the closeout is free of engine loads.

4. The apparatus of claim 1, wherein the closeout is one of a plurality of closeouts distributed about the centerline and attached to the tubular housing structure.

5. The apparatus of claim 1, further comprising:

a third rib projecting radially out from the inner wall portion, and extending axially between the first flange and the second flange; and a second closeout radially recessed into the side of and forming a second cavity with the tubular housing structure, wherein the second closeout is attached to the tubular housing structure;

wherein the second cavity extends axially between the first flange and the second flange, laterally between the first rib and the third rib, and radially outward from the inner wall portion to the second closeout.

6. The apparatus of claim 1, further comprising:

a third rib projecting radially out from the inner wall portion, and extending axially between the first flange and the second flange;

a fourth rib projecting radially out from the inner wall portion, and extending axially between the first flange and the second flange; and a second closeout radially recessed into the side of and forming a second cavity with the tubular housing structure, wherein the second closeout is attached to the tubular housing structure;

wherein the second cavity extends axially between the first flange and the second flange, laterally between the third rib and the fourth rib, and radially outward from the inner wall portion to the second closeout.

7. The apparatus of claim 1, wherein the closeout comprises sheet metal.

8. The apparatus of claim 1, wherein the closeout comprises a corrugated sheet of material.

9. The apparatus of claim 1, further comprising a fin projecting radially out from the inner wall portion and partially into the cavity.

10. The apparatus of claim 9, wherein the fin extends axially between the first flange and the second flange.

11. The apparatus of claim 1, further comprising a plurality of fins projecting radially out from the inner wall portion and partially into the cavity.

12. The apparatus of claim 1, wherein the inner wall portion has a trochoidal inner surface.

13. A rotary engine, comprising:

a tubular housing structure extending along a centerline and comprising:

an inner wall portion extending about and axially along the centerline;

a first flange projecting radially out from the inner wall portion;

a second flange projecting radially out from the inner wall portion;

a first rib projecting radially out from the inner wall portion, and extending axially between the first flange and the second flange; and a second rib projecting radially out from the inner wall portion, and extending axially between the first flange and the second flange;

a closeout radially recessed into a side of and forming a cavity with the tubular housing structure, and the closeout attached to the tubular housing structure; and a rotor arranged within an inner volume formed by and radially within the inner wall portion;

wherein the cavity extends axially between the first flange and the second flange, laterally between the first rib and the second rib, and radially outward from the inner wall portion to the closeout.

* * * * *